United States Patent [19]

Hunsucker

[11] Patent Number: 4,478,597

[45] Date of Patent: Oct. 23, 1984

[54] METHOD OF TREATING TEXTILES

[75] Inventor: Jerry H. Hunsucker, Terre Haute, Ind.

[73] Assignee: Angus Chemical Company, Northbrook, Ill.

[21] Appl. No.: 505,798

[22] Filed: Jun. 20, 1983

[51] Int. Cl.[3] ..... D06M 13/38

[52] U.S. Cl. ..... 8/181; 8/127.6

[58] Field of Search ..... 8/181, 127.6

[56] References Cited

U.S. PATENT DOCUMENTS 4,238,545 12/1980 Hunsucker et al. ..... 428/270

4,323,624 4/1982 Hunsucker et al. ..... 428/270

*Primary Examiner*—Maria Parrish Tungol

*Attorney, Agent, or Firm*—Robert H. Dewey

[57] ABSTRACT

A method of preparing a wrinkle-resistant fabric made from natural fibers consisting of the steps of (a) impregnating the fabric with a solution of tris(hydroxymethyl)-nitromethane or a mixture thereof with 2-nitro-1-butanol or 2-nitro-2-methylpropanol and catalyst therefor, and (b) heating to 150°–170° C.

9 Claims, No Drawings

METHOD OF TREATING TEXTILES

This invention relates to a method of treating textiles and non-woven cellulose products. In a particular aspect, this invention relates to a method for imparting wrinkle-resistance to textiles and non-woven fabrics.

BACKGROUND OF THE INVENTION

The importance of dimensional stability, such as wrinkle resistance and durable press properties in textile fabrics and non-woven cellulose products are well established and are of great importance and economic value to the textile industry. The majority of textile articles, both wearing apparel and household articles, available in the marketplace exhibit these properties to some beneficial degree. Although many synthetic fibers inherently possess resiliency and wrinkle resistance, fabrics containing cellulose fibers must be chemically treated to acquire these important properties needed for the modern textile market.

The principal chemical treatments which produce wrinkle resistance and durable press properties in cellulose-containing textiles and non-woven products are those in which the cellulose molecules are crosslinked, generally by reaction of a di- or poly-functional agent with the cellulose.

Many textile-treating processes have been used for imparting wrinkle resistance, but most of these employ formaldehyde in some manner or other and they contribute extractable formaldehyde to the textile. Since formaldehyde is suspected of being carcinogenic, it is essential to minimize such residues. Accordingly, there is a need for an improved process for conferring wrinkle resistance to textiles.

SUMMARY OF THE INVENTION

It is an object of this invention to provide an improved method of treating textiles and non-woven cellulosic products.

It is another object of this invention to provide a method for imparting wrinkle resistance to textiles and non-woven fabrics.

Other objects of this invention will be apparent to those skilled in the art from the disclosure herein.

It is the discovery of this invention to provide a method of preparing a wrinkle-resistant fabric comprising the steps of (a) impregnating the fabric with a solution of tris(hydroxymethyl)nitromethane (TN) or a mixture thereof with 2-nitro-2-methylpropanol and/or 2-nitro-1-butanol and catalyst therefor and (b) heating to 150°–170° C. for a length of time sufficient to effect a reaction with the fabric.

DETAILED DISCUSSION

It is known from J. H. Hunsucker, U.S. Pat. No. 4,238,545 to modify urea-formaldehyde resins used for treating resins with a nitroalkanol. According to the prior process, the textile is treated with the modified resin and a catalyst, then heated to cure the resin.

The present process is carried out in much the same manner. An aqueous solution (i.e. a padding bath) of TN, or a mixture of TN with nitrobutanol (NB) and/or nitromethylpropanol (NMP), is prepared along with a catalyst. The textile or other non-woven cellulosic object is saturated with the mixture, pressed to about a 60% wet pick-up, then heated, e.g. to within about 150°–170° C., preferably about 160° C, to effect the textile treatment.

Tris(hydroxymethyl)nitromethane, NB and NMP are highly soluble in water so the concentration in the bath is not critical. In general, a concentration of about 20% TN is preferred, but it is to be understood that broad variations from this amount may be employed without departing from the concept of this invention. When NMP or NB (or a mixture thereof in any proportion) is used, it is used in an amount of about 2–7 parts of TN to 1 of NMP or NB. NMP is generally preferred. Tris(hydroxymethyl)nitromethane, NB and NMP are commercially available and the usual commercial grade is suitable for the practice of this invention.

Catalysts used in the practice of this invention are acidic catalysts, such as salts of magnesium, zinc and alkanolamines. Such salts include chlorides, nitrates, sulfates, acetates, etc. In general these catalysts are those previously used with urea-formaldehyde resins. The amount of catalyst used may be varied to provide the desired reaction rate. In general, a concentration of about 2.0% by weight in the padding bath will be sufficient.

It is contemplated that the products and objects which will benefit from the wrinkle resistance conferred by the process of the present invention will include but will not be limited to those made from natural fibers, principally wool and cellulose, both woven and non-woven. Of the woven fibers, cotton fabrics are the ones which are expected to receive the most benefit. Non-woven fabrics are usually made from cellulose fibers, e.g. wood fibers, and are used extensively. While much of it goes to disposable items where wrinkle resistance may not be of great importance, still the market for durables is increasing, especially in clothing interliners, bedding, carpets, draperies, etc., where wrinkle resistance is important. Actually, it is contemplated that any cellulose-containing product, such as paper goods will benefit from treatment with the resin, and the term fabric as used herein is intended to encompass such cellulose-containing product.

The invention will be better understood with reference to the following examples. It is understood that the examples are intended for illustration only and it is not intended that the invention be limited thereby.

EXAMPLE 1

The following composition was prepared:

| | |
|---|---|
| Tris(hydroxymethyl)nitromethane | 19.49% by wt |
| Magnesium Chloride* | 3.13% |
| Water | 77.38% |
| | 100 |

*64% aqueous solution

A piece of cotton cloth, unsized, was dipped into the above solution, patted dry, stretched, dried for 7 minutes at 60° C., then cured in an oven at 160° C. for two minutes. Ten specimens, 40 mm long and 15 mm wide were cut from the cloth, five with their long dimension parallel to the warp and five with their long dimension parallel to the filling. The wrinkle recovery angle and tensile strength were then determined as set forth in Test Method 66-1968 of the American Association of Textile Colorists and Chemists. The wrinkle recovery values were averaged and expressed as total recovery angle, 179°. The tensile strength was 50.0/34.8.

EXAMPLE 2

The experiment of Example 1 was repeated in all essential details except that the treated cloth was cured for 3 minutes instead of 2 minutes. The wrinkle recovery, 248°, was much better because of the longer cure time and the tensile strength, 35.0/25.4 was normal for a resin treated fabric.

EXAMPLE 3

The experiment of Example 1 was repeated in all essential details except that the cloth was cured for 4 minutes instead of two. The recovery angle, 272°, is excellent, but there was a slight loss of tensile strength, 27.1/17.9.

EXAMPLE 4

The experiment of Example 2 was repeated in all essential details except that 6% of a 60% aqueous solution of 2-nitro-2-methylpropanol (NMP) (3.6% dry basis) was substituted for an equal amount of water. The recovery angle was 243° and the tensile strength was 43.2/33.7.

EXAMPLE 5

The experiment of Example 4 was repeated in all essential details except that 12% of NMP solution (7.2% dry basis) was substituted for an equal amount of water. The wrinkle recovery was 291° and the tensile strength was 28.3/19.3.

EXAMPLE 6

The experiment of Example 4 was repeated in all essential details except that 18% of the NMP solution (10.8% dry basis) was substituted for an equal amount of water. The wrinkle recovery was 267° and the tensile strength was 39.3/27.4.

I claim:

1. A method of preparing a wrinkle-resistant fabric made from natural fibers consisting of the steps of (a) impregnating the fabric with a solution consisting essentially of tris(hydroxymethyl)nitromethane or a mixture thereof with 2-nitro-1-butanol or 2-nitro-2-methylpropanol and catalyst therefor, and (b) heating to 150°-170° C.

2. A wrinkle-resistant fabric obtained by the method of claim 1.

3. A woven fabric of claim 2 made of cotton.

4. A non-woven fabric of claim 2 made from cellulose fibers.

5. The method of claim 1 wherein the fabric is a woven cotton textile.

6. The method of claim 1 wherein the fabric is a non-woven fabric of cellulose fibers.

7. The method of claim 1 wherein the fabric is impregnated with tris(hydroxymethyl)nitromethane and the catalyst.

8. The method of claim 1 wherein the fabric is impregnated with tris(hydroxymethyl)nitromethane and 2-nitro-2-methylpropanol in a ratio of 2-7:1 by weight.

9. The method of claim 1 wherein the fabric is impregnated with tris(hydroxymethyl)nitromethane and 2-nitro-1-butanol in a ratio of 2-7:1 by weight.

* * * * *